US010625984B2

(12) United States Patent
St. Pierre et al.

(10) Patent No.: US 10,625,984 B2
(45) Date of Patent: Apr. 21, 2020

(54) COUNTERWEIGHT FOR ELEVATOR SYSTEM

(71) Applicant: OTIS ELEVATOR COMPANY, Farmington, CT (US)

(72) Inventors: Bruce St. Pierre, Unionville, CT (US); Daniel B. Davis, III, Middlefield, CT (US); Bruce P. Swaybill, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 259 days.

(21) Appl. No.: 15/506,906

(22) PCT Filed: Aug. 27, 2015

(86) PCT No.: PCT/US2015/047141
§ 371 (c)(1),
(2) Date: Feb. 27, 2017

(87) PCT Pub. No.: WO2016/033302
PCT Pub. Date: Mar. 3, 2016

(65) Prior Publication Data

US 2017/0283221 A1 Oct. 5, 2017

Related U.S. Application Data

(60) Provisional application No. 62/043,133, filed on Aug. 28, 2014.

(51) Int. Cl.
*B66B 17/12* (2006.01)
*B66B 7/08* (2006.01)

(52) U.S. Cl.
CPC ..... *B66B 17/12* (2013.01); *B66B 7/085* (2013.01)

(58) Field of Classification Search
CPC .. B66B 7/06; B66B 7/08; B66B 7/085; B66B 7/10; B66B 17/12
See application file for complete search history.

(56) References Cited

U.S. PATENT DOCUMENTS 1,418,089 A 5/1922 Lindquist
1,442,060 A * 1/1923 Evans ..... B66B 7/10 187/412

(Continued)

FOREIGN PATENT DOCUMENTS

CN 1738761 A 2/2006
CN 201703935 U 1/2011

(Continued)

OTHER PUBLICATIONS

International Search Report for International Appln. No. PCT/US2015/047141; International Filing Date: Aug. 27, 2015; dated Dec. 3, 2015; 5 pages.

(Continued)

*Primary Examiner* — Minh Truong
(74) *Attorney, Agent, or Firm* — Cantor Colburn LLP

(57) ABSTRACT

A counterweight is provided including a counterweight frame including a crosshead. A counterweight hitch is operably coupled to the counterweight frame. The counterweight hitch includes a vertically stacked first sheave channel and a second sheave channel. Each of the first sheave channel and second sheave channel includes an interior cavity within which at least one individual sheave assembly is mounted. The plurality of individual sheave assemblies is substantially identical and arranged at an angle relative to a central plane of the counterweight frame.

12 Claims, 7 Drawing Sheets

(56) References Cited

U.S. PATENT DOCUMENTS

| | | | | |
|---|---|---|---|---|
| 1,550,353 | A * | 8/1925 | Evans | B66B 7/10 187/412 |
| 1,725,402 | A | 8/1929 | Lindquist | |
| 1,854,182 | A | 4/1932 | Erwin | |
| 1,901,635 | A | 3/1933 | Dunlop | |
| 1,902,161 | A * | 3/1933 | Frost | B66B 7/10 187/412 |
| 1,940,249 | A | 12/1933 | Evans | |
| 1,963,706 | A | 6/1934 | La Neve | |
| 1,964,982 | A | 7/1934 | Frost | |
| 2,322,774 | A | 6/1943 | Polack | |
| 2,704,651 | A * | 3/1955 | Cummings | B66B 7/10 254/398 |
| 7,077,241 | B1 | 7/2006 | Liebetrau et al. | |
| 7,261,187 | B2 | 8/2007 | Fischer et al. | |
| 7,549,514 | B2 * | 6/2009 | Heggli | B66B 7/021 187/266 |
| 7,665,580 | B2 | 2/2010 | Stocker et al. | |
| 8,302,740 | B2 | 11/2012 | Swaybill et al. | |
| 9,617,119 | B2 * | 4/2017 | Maruyama | B66B 11/0045 |
| 2004/0154876 | A1 | 8/2004 | Choi | |
| 2010/0258699 | A1 | 10/2010 | Boychuk et al. | |
| 2012/0160615 | A1 | 1/2012 | Girgis et al. | |
| 2014/0284148 | A1 * | 9/2014 | Albu | B66B 17/12 187/404 |

FOREIGN PATENT DOCUMENTS

| | | | |
|---|---|---|---|
| CN | 102471023 | A | 5/2012 |
| EP | 2465805 | A1 | 6/2012 |
| JP | 2005231801 | | 2/2005 |
| KR | 1020010069291 | A | 7/2001 |
| WO | 2011012504 | A1 | 2/2011 |

OTHER PUBLICATIONS

Written Opinion of the International Seaching Authority for International Appln. No. PCT/US2015/047141; International Filing Date: Aug. 27, 2015; dated Dec. 3, 2015; 5 pages.

China Patent Office, Office Action and Search Report, Application No. 201580046730.8, dated Jan. 23, 2019, English translation not available (8 pp.).

China Patent Office, Office Action and Search Report, Application No. 201580046730.8, dated Jul. 2, 2018, English translation attached (15 pp.).

* cited by examiner

COUNTERWEIGHT FOR ELEVATOR SYSTEM

CROSS REFERENCE TO RELATED APPLICATIONS

This application is a National Stage application of PCT/US2015/047141, filed Aug. 27, 2015, which claims the benefit of U.S. provisional patent application Ser. No. 62/043,133 filed Aug. 28, 2014, both of which are incorporated herein by reference.

BACKGROUND OF THE INVENTION

Embodiments of the invention relate to elevator systems, and more particularly, to an elevator system having an asymmetric counterweight.

Vertical travel of an elevator car is typically powered by a drive assembly that may be supported within an upper portion of an elevator hoistway by a support member, such as a bedplate for example. The drive assembly generally includes a traction machine composed of a gearless motor and a traction sheave, both of which may be mounted on a surface of the bedplate. Rotational torque generated by the motor is used to drive the traction sheave. Depending on the direction of rotation of the motor the traction sheave causes tension members to lift or lower the elevator car and counterweight vertically through the hoistway.

In conventional elevator systems, the counterweight is commonly positioned directly behind the elevator car, centered with the elevator car, or to the side of the elevator car. However, older elevator systems may have an asymmetrical layout, where the counterweight is not generally centered relative to the car. Modernization of these older elevator systems is time consuming and requires a costly relocation of the counterweight.

BRIEF DESCRIPTION OF THE INVENTION

According to one embodiment of the invention, a counterweight is provided including a counterweight frame including a crosshead. A counterweight hitch is operably coupled to the counterweight frame. The counterweight hitch includes a vertically stacked first sheave channel and a second sheave channel. Each of the first sheave channel and second sheave channel includes an interior cavity within which at least one individual sheave assembly is mounted. The plurality of individual sheave assemblies is substantially identical and arranged at an angle relative to a central plane of the counterweight frame.

Additionally or alternatively, the invention may incorporate one or more of the following features individually or in various combinations:

- each of the plurality of individual sheave assemblies is connected to one of the first sheave channel and the second sheave channel with a fastener;
- adjacent individual sheave assemblies are interposed between the first sheave channel and the second sheave channel;
- at least one spring pin is configured to limit rotation of each individual sheave assembly relative to the central plane of the counterweight frame.
- the counterweight hitch is coupled to the crosshead of the counterweight frame.
- the counterweight hitch extends through an opening at a top of the counterweight frame;

- the counterweight hitch extends around an exterior of a top of the counterweight frame; and
- the first sheave channel and the second sheave channel are coupled with at least one vertical upright.

According to another embodiment of the invention, an elevator system is provided including a hoistway and a car coupled with at least one car guide rail for movement within the hoistway. A counterweight is coupled with at least one counterweight guide rail for movement in the hoistway. The counterweight and the at least one counterweight guide rail is offset from a center of the car. The counterweight includes a counterweight frame having a crosshead. A counterweight hitch is operably coupled to the counterweight frame. The counterweight hitch includes a vertically stacked first sheave channel and a second sheave channel. Each of the first sheave channel and second sheave channel includes an interior cavity within which at least one individual sheave assembly is mounted. The plurality of individual sheave assemblies is substantially identical and arranged at an angle relative to a central plane of the counterweight frame. A plurality of tension members operably couples the car and the counterweight. Each tension member is arranged about one of the plurality of individual sheave of the counterweight hitch. A drive machine is configured to engage the plurality of tension members to move the car and counterweight within the hoistway.

Additionally or alternatively, the invention may incorporate one or more of the following features individually or in various combinations:

- each of the plurality of individual sheave assemblies is connected to one of the first sheave channel and the second sheave channel with a fastener;
- adjacent individual sheave assemblies are interposed between the first sheave channel and the second sheave channel;
- at least one spring pin is configured to limit rotation of each individual sheave assembly relative to the central plane of the counterweight frame;
- the counterweight hitch is coupled to the crosshead of the counterweight frame;
- the counterweight hitch extends through an opening at a top of the counterweight frame; and
- the counterweight hitch extends around an exterior of a top of the counterweight frame.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
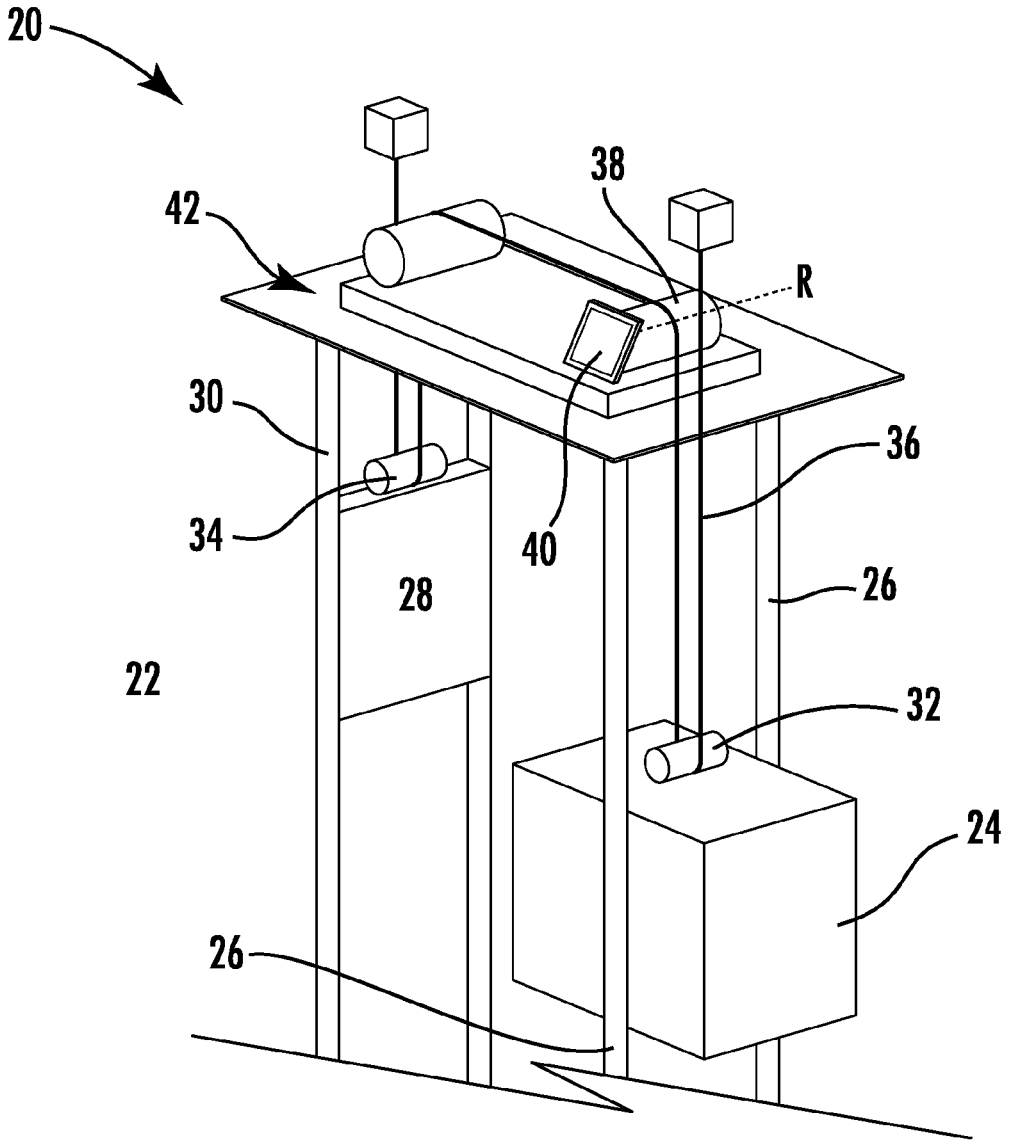
FIG. 1 is a perspective view of an example of an elevator system.

Referring now to FIG. 1, an exemplary elevator system 20 is illustrated. The elevator system 20 includes an elevator car 24 configured to move vertically upwardly and downwardly within a hoistway 22 along a plurality of car guide rails 26. Guide assemblies mounted to the top and bottom of the elevator car 24 are configured to engage the car guide rails 26 to maintain proper alignment of the elevator car 24 as it moves within the hoistway 22.

The elevator system 20 also includes a counterweight 28 configured to move vertically upwardly and downwardly within the hoistway 22. The counterweight 28 moves in a direction generally opposite the movement of the elevator car 24 as is known in conventional elevator systems. Movement of the counterweight 28 is guided by counterweight guide rails 30 mounted within the hoistway 22. In the illustrated, non-limiting embodiment, the elevator car 24 and counterweight 28 include sheave assemblies 32, 34 that cooperate with at least one tension member 36 and a traction sheave 38 mounted to a drive machine 40 to raise and lower the elevator car 24. The drive machine 40 in the illustrated embodiment of the invention is suited and sized for use with flat tension members 36. The sheave assembly 32, shown in FIG. 1, is mounted to the top of the elevator car 24. However, the sheave assembly 32 may be mounted at another location on the elevator car 24, such as the bottom of the elevator car 24 for example, or elsewhere in the system 20 as recognized by a person skilled in the art.

The drive machine 40 of the elevator system 20 is positioned and supported at a mounting location atop a support member 42, such as a bedplate for example, in a portion of the hoistway 22 or a machine room. Although the elevator system 20 illustrated and described herein has an overslung 2:1 roping configuration, elevator systems 20 having other roping configurations and hoistway layouts are within the scope of the invention.

In some embodiments, the counterweight 28 of the elevator system 10 is asymmetric, meaning that the counterweight guide rails 30 and the counterweight 28 movable within the guide rails 30 are arranged substantially offset from a center of the elevator car 24 and car guide rails 26 within the hoistway 22.

Figure 2:
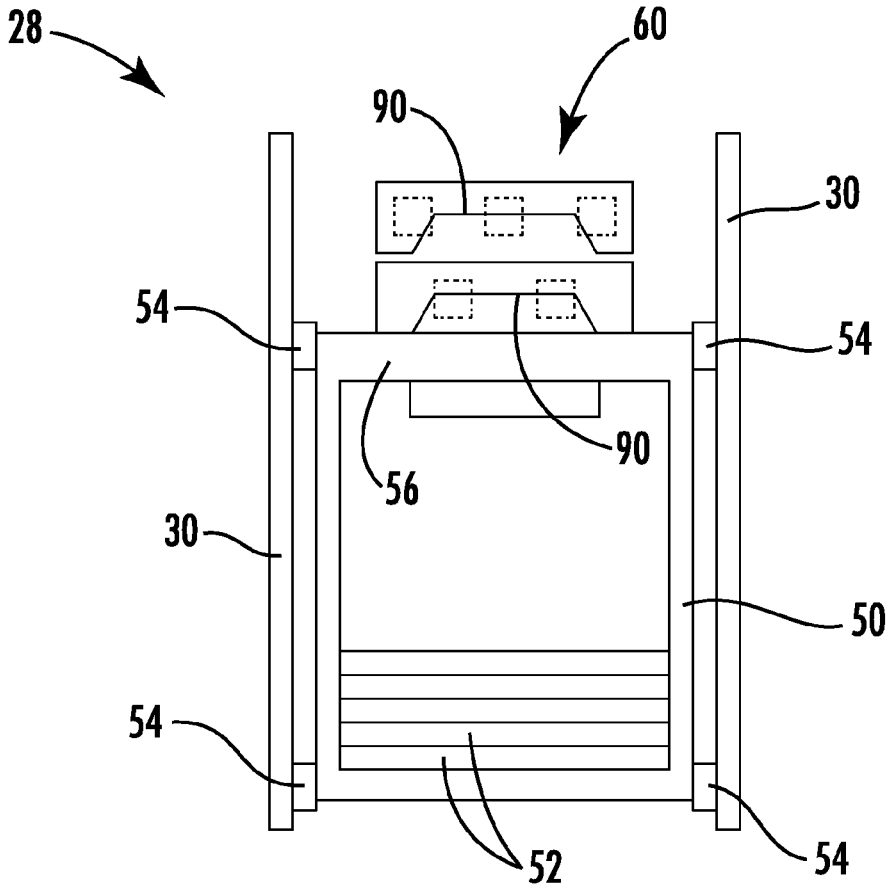
FIG. 2 is a front view of an example of a counterweight assembly according to an embodiment of the invention.

Referring now to FIG. 2, an example of a counterweight 28 is illustrated in more detail. As shown, the counterweight 28 is an assembly including a generally rectangular frame 50, such as made from a plurality of connected metal members for example. Positioned within the frame 50 are multiple weights 52 arranged in a stacked configuration. Guide assemblies 54 configured to cooperate with the counterweight guide rails 30 are fastened adjacent opposing sides of the counterweight frame 50. Connected to the upper portion 56 of the counterweight frame 50, also referred to as the crosshead, is a counterweight hitch 60. The plurality of tension members 36 are operably coupled to the counterweight hitch 60 such that movement of the tension members 36 via the drive machine 40 causes the counterweight 28 to move along the counterweight guide rails 30 within the hoistway 22.

Figure 3:
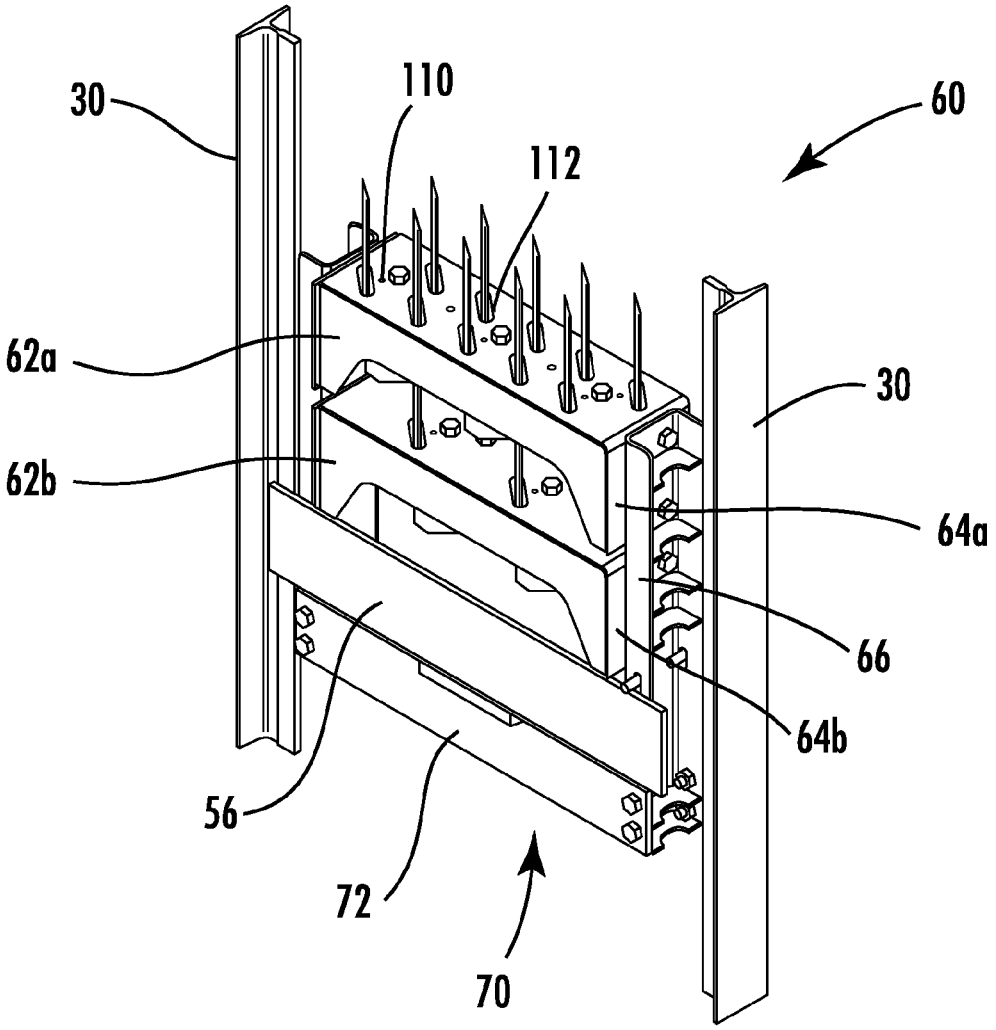
FIG. 3 is a perspective view of a counterweight hitch of the counterweight assembly according to an embodiment of the invention.
Figure 4:
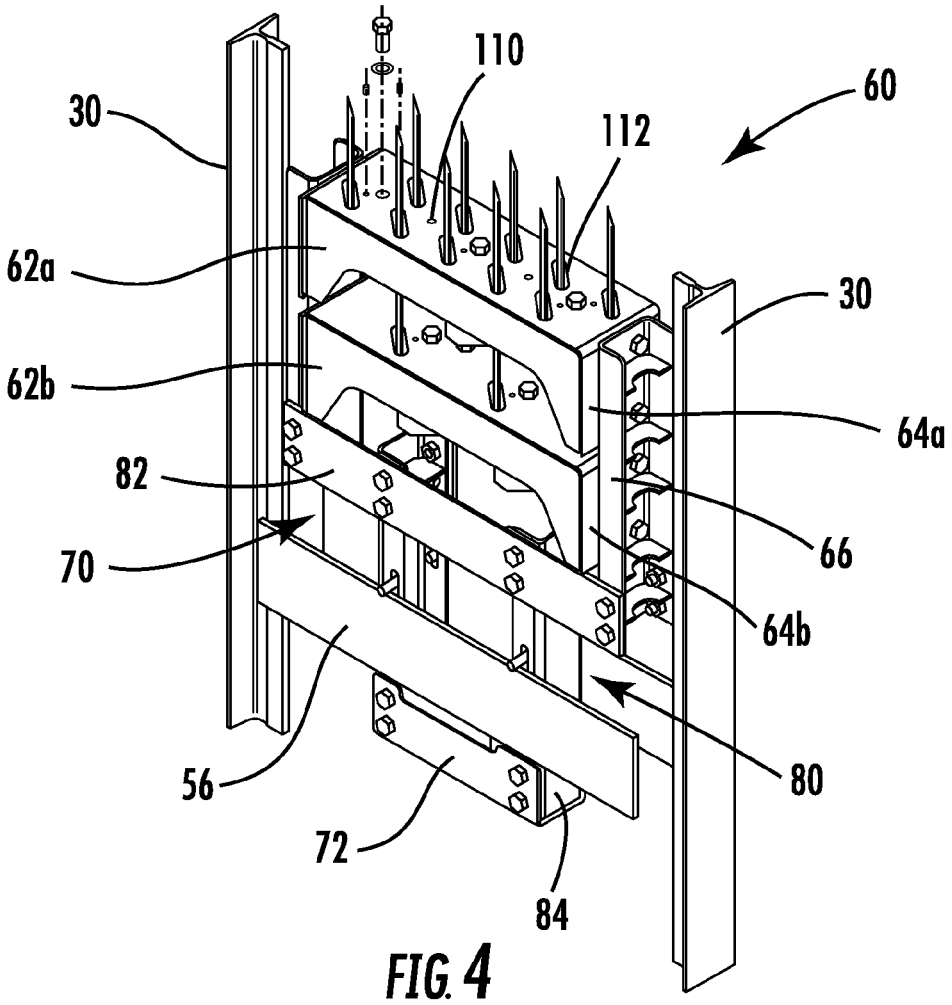
FIG. 4 is a perspective view of another counterweight hitch of the counterweight assembly according to an embodiment of the invention.
Figure 5:
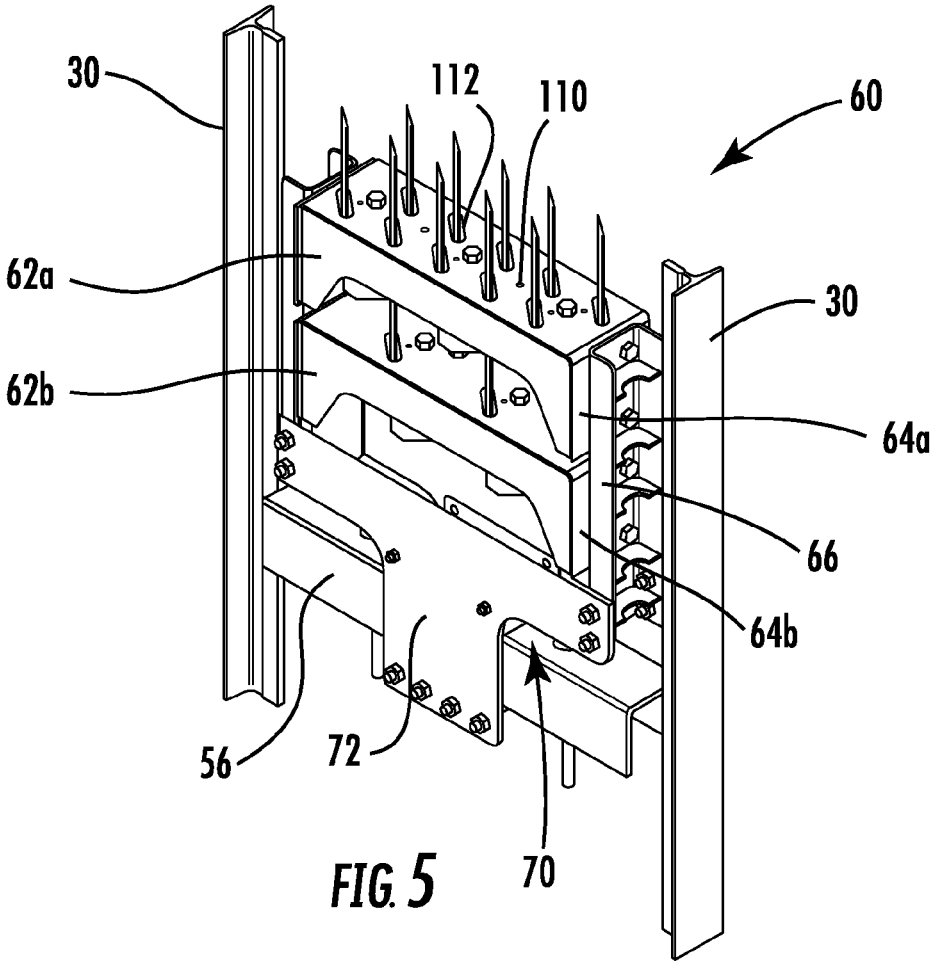
FIG. 5 is a perspective view of another counterweight hitch of the counterweight assembly according to an embodiment of the invention.

Referring now to FIGS. 3-5, the counterweight hitch 60 is provided in more detail. The counterweight hitch 60 includes a first sheave channel 62*a* and a second sheave channel 62*b* vertically disposed below the first sheave channel 62*a*. The first and second sheave channels 62*a*, 62*b* are substantially identical in shape and size, and may be formed from bent or welded metal. The adjacent end surfaces 64*a*, 64*b* of the first and second sheave channels 62*a*, 62*b* are coupled by a first and second upright 66, respectively. In the illustrated, non-limiting embodiment, the uprights 66 are C or U-shaped channels fastened, such as with bolts for example, to each sheave channel 62.

A connection assembly 70 extending from each the uprights 66 is configured to couple the counterweight hitch 60 and the counterweight frame 50. The configuration of the connection assembly 70 may vary depending on the construction of the counterweight frame 50 and more particularly, the counterweight crosshead 56. In the embodiment illustrated in FIG. 3, the connection assembly 70 includes a first connection member 72 mounted to a first side 68 of the uprights 66 and a second connection member 74 mounted to a second, opposite side 69 of the uprights 66 (see FIG. 3*a*). In one embodiment, the first connection member 72 and the second connection member 74 may be integrally formed. The first connection member 72 and the second connection member 74 extend generally outwardly from the uprights 66 to increase the depth of the counterweight hitch 60 beyond the depth of the counterweight frame 50. The counterweight hitch 60 generally extends through a central opening 58 in the top of the frame 50 such that an upper surface 76 of the first and second connection members 72, 74 contacts and engages an adjacent surface of the crosshead 56.

In the embodiment illustrated in FIG. 4, the connection assembly 70 includes a support frame 80 extending vertically downward from a first crosspiece 82 and a second crosspiece (not shown) mounted to the first and second uprights 66. The support frame 80 is configured to extend through the central opening 58 in the top of the counterweight frame 50 such that the base 84 of the support frame 80 is directly underneath the crosshead 56. The base 84 of the support frame 80 includes a first connection member 72 and a second connection member (not shown) configured to contact and operably couple the support frame 80, and therefore the counterweight hitch 60 to the counterweight crosshead 56. In the illustrated, non-limiting embodiment, the first connection member 72 and the second connection member 74 are integrally formed as a bent channel.

The connection assembly 70 illustrated in FIG. 5 is intended for use with a counterweight 28 having a solid and/or narrow counterweight frame 50. A thin first connection member 72 is mounted to a first side 68 of the uprights 66 and a substantially identical second connection member 74 is mounted to a second, opposite side 69 of the uprights 66. In one embodiment, the first and second connection members 72, 74 are formed from sheet metal. In the illustrated, non-limiting embodiment, the connection members 72, 74 are T-shaped and have an elongated central portion extending vertically downward around the exterior of the counterweight frame 50. One or more fasteners 88 couple the free ends 86 of the central portion of the first and second connection members 72, 74. Because the free ends 86 are disposed just below the crosshead 56, the at least one fastener 88 is configured to contact and engage the crosshead 56 such that the counterweight frame 50 and hitch 60 move together through the hoistway 22.

Figure 6:
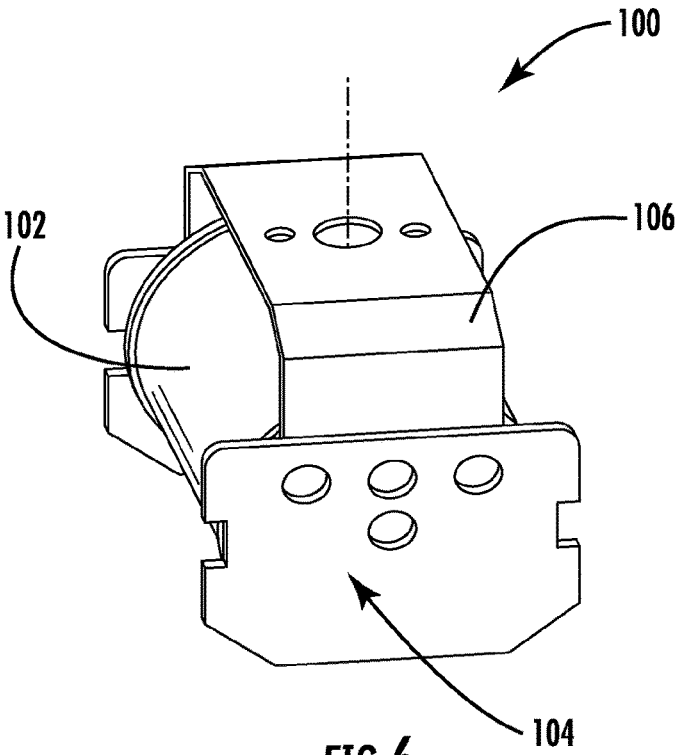
FIG. 6 is a perspective view of an individual sheave assembly configured for use with the counterweight hitch according to an embodiment of the invention.

Referring again to FIG. 2, each of the sheave channels 62*a*, 62*b* is configured to define an interior cavity 90 within which at least one individual sheave assembly 100 is positioned (best shown in FIG. 6). The quantity of individual sheave assemblies 100 mounted to each sheave channel 62*a*, 62*b* depends on the total number of tension members 36 within the elevator system 20. Adjacent tension members 36 are received by individual sheave assemblies 100 alternating between the first and second sheave channel 62*a*, 62*b*. For example, in an elevator system 20 having five tension members 36, the end and central tension members 36 are received around individual sheave assemblies 100 mounted to the first sheave channel 62*a* and the second and fourth tension members 36 are received by sheave assemblies 100 mounted to the second sheave channel 62*b*.

Figure 6A:
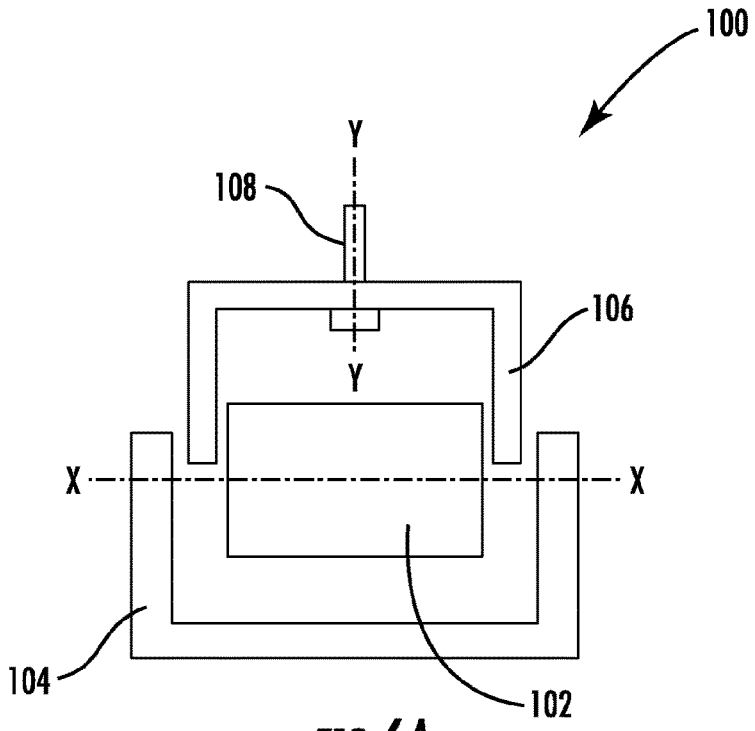
FIG. 6*a* is a side view of the individual sheave assembly of FIG. 6.

The individual sheave assemblies 100 are substantially identical and each is configured to receive a single tension member 36 of the elevator system 20. An example of an individual sheave assembly 100 is illustrated in FIGS. 6 and 6*a*. In the illustrated, non-limiting embodiment, the individual sheave assembly 100 includes a sheave 102 mounted to an adjacent support 104 such that the sheave 102 is configured to rotate about an axis of rotation X. A bracket 106 connected to the support 104 is configured to operably couple the sheave assembly 100 within the interior cavity 90 of the sheave channels 62*a*, 62*b* with a fastener 108 such that the sheave assembly 100 is generally rotatably about an axis Y defined by the fastener 108.

Figure 3A:
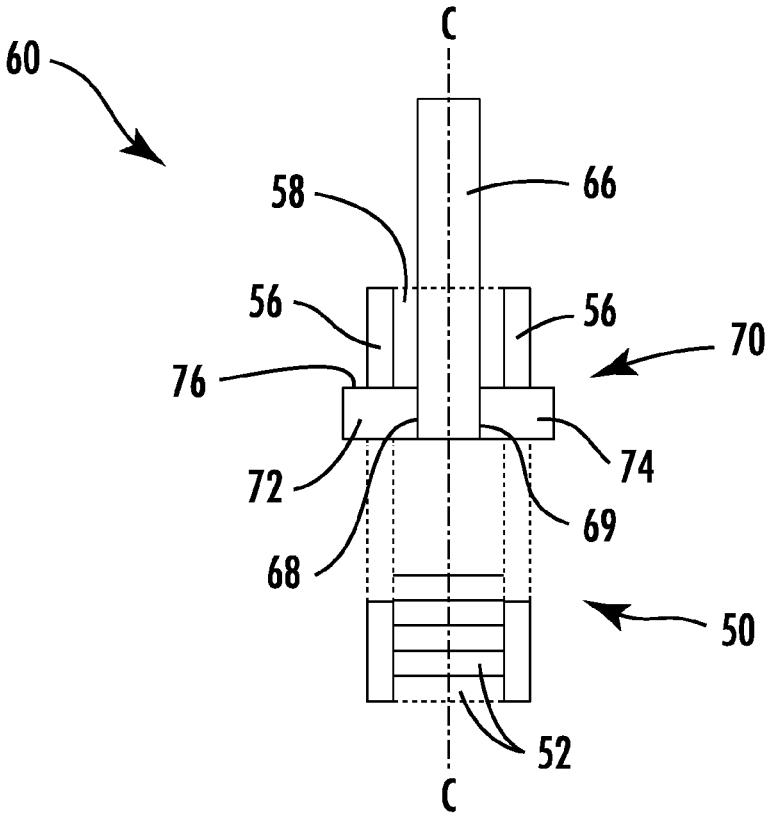
FIG. 3*a* is a side view of a the counterweight assembly of FIG. 3.

Each of the individual sheave assemblies 100 is mounted to a sheave channel 62*a*, 62*b* of the counterweight hitch 60 at an angle relative to a central plane C of the counterweight frame 50 (see FIG. 3*a*). The angle of each individual sheave assembly 100 is substantially identical and is determined based upon the asymmetry of the counterweight 28 within the hoistway 22. At least one spring pin 110 is used to bias each individual sheave assembly 100 to the desired angle to prevent rotation of the sheave assembly 100 during operation of the elevator system 20. In addition, complementary angled slots 112 are formed in each of the sheave channels 62*a*, 62*b* to receive the tensions members 36 about the sheave assemblies 100.

By mounting the individual sheave assemblies 100 at an angle relative to the central plane C of the counterweight frame 50, the tension members 36 can connect the asymmetrical counterweight 28 and the elevator car 24 without requiring one or more twists. This results in improved tracking and increases the life of the tensions members 36.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A counterweight comprising:

a counterweight frame including a crosshead; and a counterweight hitch operably coupled to the counterweight frame, the counterweight hitch including a first sheave channel and a second sheave channel vertically coupled to one another and connected to the counterweight hitch by a first upright and a second upright, each of the first sheave channel and second sheave channel includes an interior cavity within which at least one individual sheave assembly is mounted, each individual sheave assembly includes a sheave having an axis of rotation extending between a first end and a second end of the sheave, and the plurality of individual sheave assemblies being substantially identical and arranged at an angle relative to a central plane of the counterweight frame such that the axis of rotation is at an angle to the counterweight frame, wherein the angle of the plurality of individual sheave assemblies is substantially identical.

2. The counterweight according to claim 1, wherein each of the plurality of individual sheave assemblies is connected to one of the first sheave channel and the second sheave channel with a fastener.

3. The counterweight according to claim 1, wherein at least one spring pin is configured to limit rotation of each individual sheave assembly relative to the central plane of the counterweight frame.

4. The counterweight according to claim 1, wherein the counterweight hitch is coupled to the crosshead of the counterweight frame.

5. The counterweight according to claim 4, wherein the counterweight hitch extends through an opening at a top of the counterweight frame.

6. The counterweight according to claim 4, wherein the counterweight hitch extends around an exterior of a top of the counterweight frame.

7. An elevator system, comprising:

a hoistway having a machine room arranged at a first end;

a car coupled with at least one car guide rail for movement in the hoistway;

a counterweight coupled with at least one counterweight guide rail for movement in the hoistway, the counterweight and the at least one counterweight guide rail being offset from a center of the car, the counterweight including:

a counterweight frame including a crosshead; and a counterweight hitch operably coupled to the counterweight frame, the counterweight hitch including a first sheave channel and a second sheave channel vertically coupled to one another and connected to the counterweight hitch by a first upright and a second upright, each of the first sheave channel and second sheave channel includes an interior cavity within which at least one individual sheave assembly is mounted, and the plurality of individual sheave assemblies being substantially identical and arranged at an angle relative to a central plane of the counterweight frame;

a plurality of tension members operably coupling the car and the counterweight, each of the plurality of tension members being arranged about one of the plurality of individual sheaves of the counterweight hitch; and a drive machine configured to engage the plurality of tension members to move the car and counterweight within the hoistway.

8. The elevator system according to claim 7, wherein each of the plurality of individual sheave assemblies is connected to one of the first sheave channel and the second sheave channel with a fastener.

9. The elevator system according to claim 7, wherein at least one spring pin is configured to limit rotation of each individual sheave assembly relative to the central plane of the counterweight frame.

10. The elevator system according to claim 7, wherein the counterweight hitch is coupled to the crosshead of the counterweight frame.

11. The elevator system according to claim 10, wherein the counterweight hitch extends through an opening at a top of the counterweight frame.

12. The elevator system according to claim 10, wherein the counterweight hitch extends around an exterior of a top of the counterweight frame.

* * * * *